US010629066B2

(12) United States Patent
Gordijn et al.

(10) Patent No.: US 10,629,066 B2
(45) Date of Patent: Apr. 21, 2020

(54) CONTROL DEVICE FOR A DOMESTIC APPLIANCE SYSTEM

(71) Applicant: KONINKLIJKE PHILIPS N.V., Eindhoven (NL)

(72) Inventors: Sandor Hurbertus Florentius Gordijn, Mierlo (NL); Navin Hemchand Natoewal, Utrecht (NL); Hendricus Theodorus Gerardus Maria Penning De Vries, Mierlo (NL)

(73) Assignee: Koninklijke Philips N.V., Eindhoven (NL)

( * ) Notice: Subject to any disclaimer, the term of this patent is extended or adjusted under 35 U.S.C. 154(b) by 0 days.

(21) Appl. No.: 15/780,417

(22) PCT Filed: Dec. 1, 2016

(86) PCT No.: PCT/EP2016/079445
§ 371 (c)(1),
(2) Date: May 31, 2018

(87) PCT Pub. No.: WO2017/093411
PCT Pub. Date: Jun. 8, 2017

(65) Prior Publication Data

US 2018/0365976 A1 Dec. 20, 2018

(30) Foreign Application Priority Data

Dec. 2, 2015 (EP) ..... 15197553

(51) Int. Cl.
*G08C 17/02* (2006.01)
*G08C 17/00* (2006.01)
(Continued)

(52) U.S. Cl.
CPC ..... *G08C 17/02* (2013.01); *G08C 17/00* (2013.01); *G08C 19/00* (2013.01); *G08C 23/04* (2013.01);
(Continued)

(58) Field of Classification Search
CPC ..... G08C 17/02; G08C 2201/71; G08C 2201/92; G08C 23/04; G08C 19/00
See application file for complete search history.

(56) References Cited

U.S. PATENT DOCUMENTS 6,812,881 B1 11/2004 Mullaly et al.
7,586,398 B2 9/2009 Huang et al.
(Continued)

FOREIGN PATENT DOCUMENTS

EP 2084944 B1 5/2012
WO 2006111934 A1 10/2006
WO 2011007388 A1 1/2011

OTHER PUBLICATIONS

"UWand for Smart(er) Home Interaction", Philips, rev. 1.0, 2014, pp. 1-7.

*Primary Examiner* — Brian E Miller

(57) ABSTRACT

A control device (130) for controlling a domestic appliance system (100) comprises: a first remote controllable device (110), a second remote controllable device (120) and a remote control (150). The remote control typically comprises a pointing detection unit (140) configured for identifying a remote controllable device (110, 120) at which the remote control is pointing (156, 156'). The remote control is configured for commanding a read in response to a user input commanding a copy while the user points the remote control at the first device and the remote control is configured for commanding a write in response to a user input commanding a paste while the user points the remote control at the second device. The control device comprises: a
(Continued)

reception unit (310) configured for receiving a first value of the first device in response to the read; and a conversion unit (320) coupled to the reception unit configured for determining a third value based on the first value for replacing a value of the second device in response to the write for influencing the functioning of the second device. Hence the control device couples remote controllable devices of a domestic appliance system for providing the user with an intuitive drag and drop system for controlling these devices.

14 Claims, 10 Drawing Sheets

(51) Int. Cl.
*G08C 19/00* (2006.01)
*G08C 23/04* (2006.01)

(52) U.S. Cl.
CPC ..... *G08C 2201/20* (2013.01); *G08C 2201/71* (2013.01); *G08C 2201/92* (2013.01)

(56) References Cited

U.S. PATENT DOCUMENTS

| | | | | |
|---|---|---|---|---|
| 8,539,541 | B2 | 9/2013 | Kim et al. | |
| 2003/0073461 | A1* | 4/2003 | Sinclair | G08C 17/02 455/557 |
| 2009/0015433 | A1* | 1/2009 | James | G08C 17/02 340/12.22 |
| 2009/0102696 | A1 | 4/2009 | Park et al. | |
| 2009/0185081 | A1* | 7/2009 | Ueno | G08C 17/02 348/734 |
| 2009/0265217 | A1* | 10/2009 | Aurenz | G08C 17/02 709/218 |
| 2010/0060418 | A1* | 3/2010 | Tarizzo | G08C 17/02 340/5.83 |
| 2010/0151825 | A1* | 6/2010 | Millet Sancho | G08C 17/02 455/411 |
| 2011/0057518 | A1* | 3/2011 | Gilbert | G06F 1/266 307/112 |
| 2015/0194048 | A1* | 7/2015 | Haubrich | G08C 17/02 340/12.5 |
| 2017/0365163 | A1* | 12/2017 | MacKenzie | G01S 13/003 |
| 2018/0365976 | A1* | 12/2018 | Gordijn | G08C 17/00 |

* cited by examiner

500

| | **identifier** | ID 0 | ID 1 | ID 2 | ID 3 | Format |
|---|---|---|---|---|---|---|
| | **Device** | Lamp Type 1 | Lamp Type 2 | Picture frame | Smart TV | |
| **Attribute** | | | | | | |
| Picture A | | | | RW | RW | Format Bitmap |
| Picture B | | | | R | RW | Format JPEG |
| Intensity | | RW | RW | | | |
| Light Colour A | | W | | | RW | RGB, for TV: set ambient light or screen colour |
| Light Colour B | | | RW | | RW | Hue Saturation, for TV: set ambient light or screen colour |
| Lamp UI A | | RW | RW | RW | RW | User interface 'basic' |
| Lamp UI B | | | RW | | RW | User interface 'extended' |

Fig. 8A

510

| **Item** | destination | | Television | Picture frame |
|---|---|---|---|---|
| source | **identifier** | | 1 | 2 |
| | | **attribute** | screen | picture |
| Television | 1 | screen | | |
| Picture frame | 2 | picture | x | |

Fig. 8B

CONTROL DEVICE FOR A DOMESTIC APPLIANCE SYSTEM

CROSS-REFERENCE TO PRIOR APPLICATIONS

This application is the U.S. National Phase application under 35 U.S.C. § 371 of International Application No. PCT/EP2016/079445, filed on 1 Dec. 2016, which claims the benefit of European Patent Application No. 15197553.9, filed on 2 Dec. 2015. These applications are hereby incorporated by reference herein.

FIELD OF THE INVENTION

The invention relates to the field of a control device for controlling a domestic appliance system. The invention further relates to a remote control for controlling a domestic appliance system. The invention further relates to domestic appliance systems. The invention further relates to remote controllable device for a domestic appliance system. The invention further relates to a method for controlling a control device for controlling a domestic appliance system. The invention further relates to a method for controlling a remote control. The invention further relates to a computer program products for controlling a control device for controlling a domestic appliance system or a remote control for controlling a domestic appliance system.

For control of a domestic device, such as any consumer electronics device, e.g. television, DVD player, tuner, etc., a remote control is generally used. However, in the average household, multiple remote controls can be required, often one for each consumer electronics device. Even for a person well acquainted with the consumer electronics devices he owns, it is a challenge to remember what each button on each remote control is actually for.

A universal remote control device can be used to control a number of domestic devices. Since the universal remote control is not capable of distinguishing one domestic device from another, the universal remote control must be equipped with a dedicated button for each domestic device, and the user must explicitly press the appropriate button before interacting with the desired domestic device.

BACKGROUND OF THE INVENTION

EP2084944B1 discloses a lighting system for controlling a plurality of light sources with a remote control. A single light control interface is coupled with the plurality of light sources. The light control interface has for each light source a light attribute having a value controlling the respective light source. The light attribute may be an intensity, a colour temperature, a direction, dynamics, hue and/or saturation of the emitted light.

Each light source has a receiver for receiving infrared (IR) commands from the remote control. The commands are received by the receiver and passed on to a command converter. The command converter converts the received infrared (IR) commands into RS232 signals. The RS232 signals are passed on to a system controller. The system controller determines which light attribute in the light control interface needs to be copied and pasted according to the RS232 signals. Hence the lighting system allows for the remote control to transmit a copy command to a first light source and to transmit a paste command to a second light source while the remote control is pointing to the respective light sources.

SUMMARY OF THE INVENTION

A disadvantage of the lighting system of EP2084944B1 is that the system only allows control over identical light sources.

An object of the present invention is to provide an intuitive system/method for controlling a domestic appliance system.

For this purpose, according to a first aspect of the invention, a control device for controlling a domestic appliance system, wherein the domestic appliance system comprises: a first remote controllable device having at least one first attribute in use having a first label and a first value for controlling the first remote controllable device, the first remote controllable device being associable with a first device identifier; a second remote controllable device in use having at least one second attribute having a second label and a second value for controlling the second remote controllable device, the second remote controllable device being associable with a second device identifier; a remote control comprising an input device configured for receiving user input; a pointing detection unit configured for identifying a remote controllable device at which the remote control is pointing, based on a device identifier associated with the remote controllable device; the remote control being configured for commanding a read in response to a user input commanding a copy while a user points the remote control at the first remote controllable device; the remote control being configured for commanding a write in response to a user input commanding a paste while the user points the remote control at the second remote controllable device; and the control device comprises: a reception unit configured for receiving the first device identifier in response to the read and for receiving the second device identifier in response to the write; a conversion unit coupled to the reception unit configured for determining a third value for replacing the second value based on the first device identifier, the second device identifier and the first value.

A remote controllable device may comprise one or more attributes. Each attribute has a label and a value. The label identifies the attribute. The value may control and/or influence one or more functions of the remote controllable device. For example a value of a channel attribute of a remote controllable television determines what is shown on the television. As another example a value of a colour attribute of a remote controllable lamp determines the colour of the lamp.

A remote controllable device may be associated with a device identifier. The association may be present during operation of the remote controllable device. The association may be set-up during installation, manufacturing and/or switching on of the remote controllable device. The device identifier identifies the remote controllable device. The device identifier may specify a type, a version, a sort and/or a unique identifier of the remote controllable device. The device identifier may be part of a unique remote controllable device identifier, such as a device address in a network.

The first value of the first attribute controls and/or influences one or more functions of the first remote controllable device. The second value of the second attribute controls and/or influences one or more functions of the second remote controllable device.

A user may by pointing and activating and deactivating of a remote control cause the first device identifier and the second device identifier to be sent to the control device. The first device identifier and the second device identifier identify respectively the first remote controllable device and the second remote controllable device. The control device may hold knowledge of which first value may be received from the first remote controllable device by the control device and/or which value may be sent to the second remote controllable device by the control device for replacing the second value. Determining the third value may thus comprise selecting the first label and/or the second label by combining the knowledge of the control device and the received first and second device identifiers. A first combination of the first device identifier and the first label may identify the first value. A second combination of the second device identifier and the second label may identify the second value that is to be replaced. Herewith the control device may retrieve the first value and replace the second value. Hence, determining the third value may comprise selecting the first and/or second label, which has the effect that the control device provides the user with a control of and/or an influence over the second remote controllable device based on the first device identifier, the second device identifier and the first value. Hence providing the user with an intuitive drag and drop system for controlling different devices of a domestic appliance system.

Furthermore, a user may by pointing and activating and deactivating of a remote control cause the first device identifier and the second device identifier to be sent to the control device. The first device identifier and the second device identifier identify respectively the first remote controllable device and the second remote controllable device. The control device may hold knowledge of how to convert the first value into the third value for replacing the second value. Determining the third value may thus comprise selecting a conversion from the first value into the third value by combining the knowledge of the control device and the received first and second device identifiers. Hence, determining the third value may comprise selecting the conversion, which has the effect that the control device provides the user with a control of and/or an influence over the second remote controllable device based on the first device identifier, the second device identifier and the first value. Hence providing the user with an intuitive drag and drop system for controlling different devices of a domestic appliance system.

In an embodiment of the control device, determining the third value comprises selecting, based on the first device identifier and the second device identifier, the first label for transmitting the first label to the first remote controllable device for retrieving the first value. This embodiment provides the advantage that the control device retrieves the first value actively for determining the third value for replacing the second value.

In an embodiment of the control device, determining the third value comprises selecting, based on the first device identifier and the second device identifier, the second label for transmitting the second label to the second remote controllable device for replacing the second value. This embodiment provides the advantage that the control device provides the second remote controllable device with information on which value of which attribute to replace.

In an embodiment of the control device, determining the third value comprises selecting a conversion, based on the first device identifier and the second device identifier, for converting the first value into the third value. This embodiment provides the advantage that the control device selects the appropriate conversion for converting the first value to the third value for replacing the second value. In an alternative embodiment selecting the conversion is based on the first and second label. In a further embodiment of the control device, the reception unit is configured for receiving the first value from the first remote controllable device.

In an embodiment of the control device, determining the third value comprises selecting, based on the first device identifier and the second device identifier, the second label for transmitting the second label to the second remote controllable device for retrieving the second value. This embodiment provides the advantage that the control device may base the conversion of the first value into the third value further on the second value. For example, if the second value indicates the second remote controllable device is off, the control device may determine a third value including a ramp-up or ramp-down towards the third value.

In an embodiment of the control device, the conversion unit is arranged for determining the first label and/or the second label using a first table and/or a conversion, such as relation, for converting the first value into the third value, using a second table. The first table may for example be used to hold the knowledge of which first value may be sent from the first remote controllable device and/or which value may be received by the second remote controllable device for replacing the second value. The second table may as another example be used to hold the knowledge of conversions or relations of which first value may be converted by a relation to which third value for replacing the second value. The first device identifier may be used to select a row in the table, the second device identifier may be used to select a column in the table or vice versa. This embodiment provides the advantage that the table may be an efficient way to store the knowledge of the control device.

In an embodiment of the control device, the conversion unit is arranged for a relation for defining the conversion from the first value into the third value for replacing the second value. This embodiment provides the advantage that the relation is an efficient way of storing the conversion.

In an embodiment of the control device, the conversion unit is configured for determining an intermediate value based on the first device identifier and the first value for determining the third value based on the second device identifier and the intermediate value. For example a table, having a first device identifier to select a row and a second device identifier to select a column of the table, specifying a specific conversion in each cell will increase more than linear, such as quadratic, with the amount of remote controllable devices added to the domestic appliance system. The increase of the amount of conversions according to the example when an intermediate attribute is used may be linear or less. This embodiment provides the advantage that the intermediate value may reduce the amount of specific conversion from a first value to a second value.

In an embodiment of the control device, the control device receives a first value for determining multiple third values for replacing multiple second values of multiple second attributes of a second remote controllable device. This embodiment provides the advantage of coupling one first value with multiple second values.

In an embodiment of the control device, the control device receives multiple first values of a first remote controllable device for determining a third value for replacing a second value of a second attribute. This embodiment provides the advantage of coupling multiple first values with one second value.

In an embodiment of the control device, the control device receives multiple first values of a first remote controllable device for determining multiple third value for replacing multiple second values of multiple second attributes of a second remote controllable device. This embodiment provides the advantage of coupling multiple first values with multiple second values.

For this purpose, according to another aspect of the invention, a domestic appliance system comprising: a first remote controllable device having at least one first attribute in use having a first label and a first value for controlling the first remote controllable device, the first remote controllable device being associable with a first device identifier; a second remote controllable device in use having at least one second attribute having a second label and a second value for controlling the second remote controllable device, the second remote controllable device being associable with a second device identifier; a remote control comprising an input device configured for receiving user input; a pointing detection unit configured for identifying a remote controllable device at which the remote control is pointing, based on a device identifier associated with the remote controllable device; the remote control is configured for commanding a read in response to a user input commanding a copy while the user points the remote control at the first remote controllable device; and the remote control is configured for commanding a write in response to a user input commanding a paste while the user points the remote control at the second remote controllable device; and the control device according to the invention.

In an embodiment of the domestic appliance system, determining the third value comprises selecting, based on the first device identifier and the second device identifier, the first label for transmitting the first label to the first remote controllable device for retrieving the first value.

In an embodiment of the domestic appliance system, the reception unit is configured for receiving the first value from the first remote controllable device; and determining the third value comprises converting, based on the first device identifier and the second device identifier, the first value into the third value.

In an embodiment of the domestic appliance system, the device identifier is comprised in a device identification unit comprises a beacon for emitting a beacon identifier, wherein the beacon identifier is the device identifier, wherein the remote control comprises the pointing detection unit and wherein the pointing detection unit is a directional sensitive sensor for detecting the beacon identifier and for determining at which remote controllable device the remote control is pointing. This embodiment overcomes the disadvantage of a need for selecting an applicable focussed IR beam by letting remote controllable devices emit a beacon identifier.

In a further embodiment of the domestic appliance system, the directional sensitive sensor is a camera. The camera may have a central optical axis, defining the preferred direction or reception of a beacon identifier. For example in the case multiple beacon identifiers are received by the camera, the beacon identifier closest to the optical axis of the camera is selected as the remote controllable device the remote control is pointing at.

For this purpose, according to another aspect of the invention, a remote control comprising a control device according to the invention. This embodiment provides the advantage of minimizing the amount of devices in the domestic appliance system. Another advantage of this embodiment is that the length of a communication path is minimized. The communication path being a path for passing information along, such as the first value, the second value and the third value.

The remote control of EP2084944B1 emits IR commands in a focussed IR beam to be able to select a remote controllable device for control. If no focussed IR beam was used, any remote controllable device would be selected when an IR command was emitted. A disadvantage of a too narrow focussed IR beam is that the user has to point the remote control precisely to the receiver, because otherwise the remote controllable device will not receive the IR command. A disadvantage of a too broad focussed IR beam is that two remote controllable devices placed in relative proximity of each other may both receive the IR command. Hence selecting an applicable focussed IR beam poses a problem.

In an embodiment of the remote control, the remote control comprises the pointing detection unit; wherein the pointing detection unit is a directional sensitive sensor for detecting a beacon identifier emitted by a beacon associated with a remote controllable device and for determining at which remote controllable device the remote control is pointing; and wherein the beacon identifier is the device identifier. The effect of having the pointing detection unit in the remote control is that there is no need any more for selecting an applicable IR beam.

In an embodiment of the remote control, the remote control comprise an input device configured for receiving commands of the user. The copy command of the user may be an activation of the input device. The paste command of the user may be a deactivation of the input device.

For example the activation of the input device may be a pressing of a key and the deactivation of the input device may be a releasing of the same key. The period between the activation and deactivation of the input device may than be associated with holding the input device. The user may associate the pointing and activation and deactivation with dragging and dropping as it is known on a computer screen with for example a mouse. The use of a key may improve intuitiveness of the invention. The association with dragging or dropping from a computer system may be provided by other input device than a key, such as a slider, a switch, a push button and/or two push buttons.

For this purpose, according to another aspect of the invention, a remote controllable device for a domestic appliance system, wherein the remote controllable device has a first attribute having a first value for controlling the remote controllable device; wherein the remote controllable device is configured for receiving a read command and upon receiving transmitting the first value. This embodiment provides the advantage that the remote controllable device may be used in a domestic appliance system according to the invention.

In an embodiment of the first remote controllable device and/or the second remote controllable device are one of a group of devices consisting of a television, a DVD player, a radio, a CD player, a lamp, an air conditioner, a microwave oven, an air heat oven, a stove, a refrigerator, a lamp, a thermostat, a computer, a tablet and a smartphone. In an embodiment of the control device, the first remote controllable device and the second remote controllable device are of different type.

For this purpose, according to another aspect of the invention, a method is provided for controlling a control device, wherein the method comprises the steps of: receiving the first device identifier in response to the read and the second device identifier in response to the write; and determining a third value for replacing the second value based on the first device identifier, the second device identifier and the first value.

For this purpose, according to another aspect of the invention, a method is provided for controlling a domestic appliance system, wherein the method comprises the steps of: commanding the read of the first remote controllable device in response to the user commanding the copy, while the user points the remote control at the first remote controllable device; commanding the write to the second remote controllable device in response to the user commanding the paste, while the user points the remote control at the second remote controllable device; receiving the first device identifier in response to the read and the second device identifier in response to the write; and determining a third value for replacing the second value based on the first device identifier, the second device identifier and the first value.

For this purpose, according to another aspect of the invention, a computer program product is provided for a control device comprising a processor, which computer program product is operative to cause the processor to perform a method for the control device according to the invention and/or for a remote control comprising a processor, which computer program product is operative to cause the processor to perform a method for the remote control according to the invention.

A domestic appliance system may further be called a smart home environment.

Further preferred embodiments of the device and method according to the invention are given in the appended claims, disclosure of which is incorporated herein by reference.

BRIEF DESCRIPTION OF THE DRAWINGS

These and other aspects of the invention will be apparent from and elucidated further with reference to the embodiments described by way of example in the following description and with reference to the accompanying drawings, in which:

FIG. 8 shows schematically an embodiment of a computer program product.

The figures are purely diagrammatic and not drawn to scale. In the Figures, elements which correspond to elements already described may have the same reference numerals.

DETAILED DESCRIPTION OF EMBODIMENTS

The following figures detail different embodiments of the invention.

Figure 1:
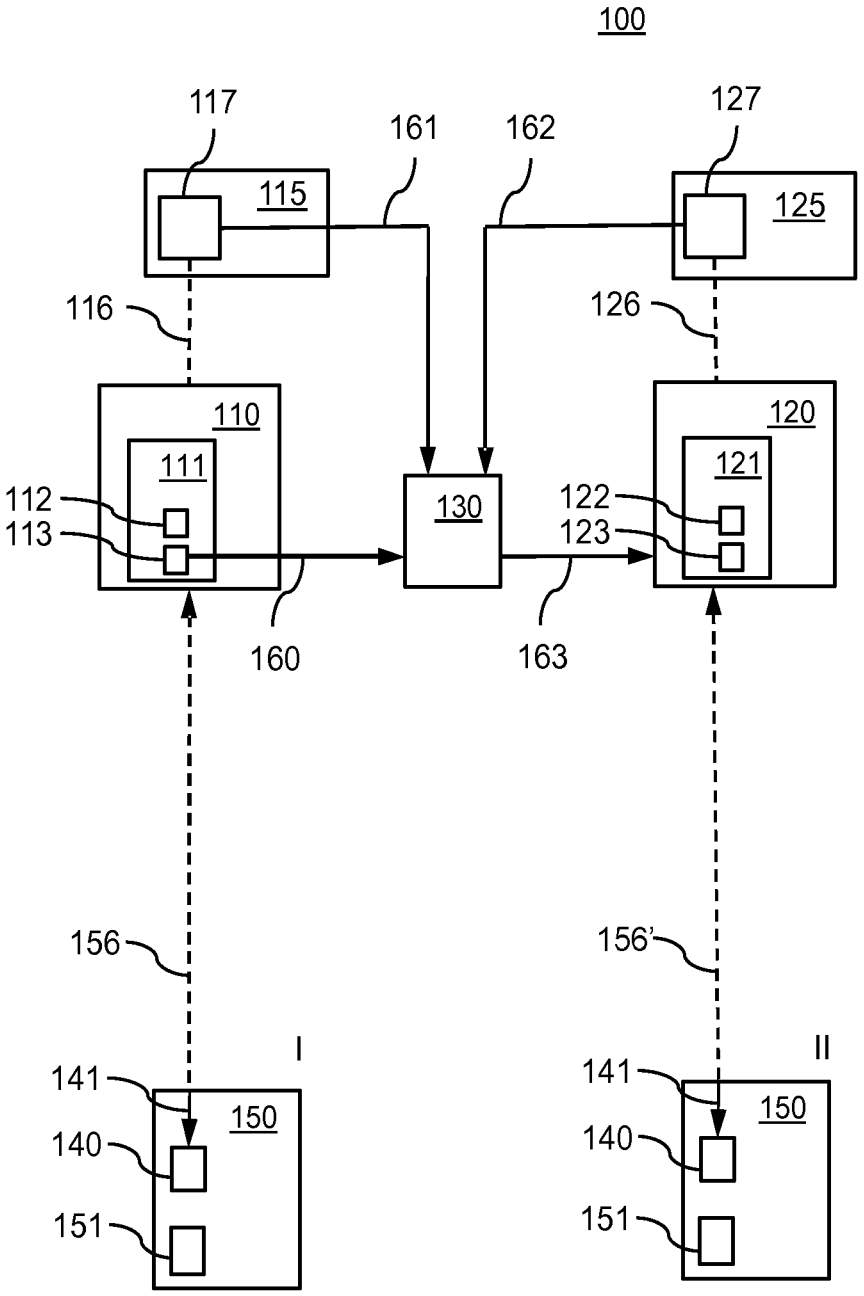
FIG. 1 shows schematically an embodiment of a domestic appliance system.

FIG. 1 shows schematically an embodiment of a domestic appliance system 100. The domestic appliance system comprises a first remote controllable device 110, a first remote controllable device identification unit 115, a second remote controllable device 120, a second remote controllable device identification unit 125, a control device 130 and a remote control 150.

The first remote controllable device comprises a first attribute 111 in use having a first label 113 and a first value 112. The second remote controllable device comprises a second attribute 121 in use having a second label 123 and a second value 122. An attribute of a remote controllable device may control functioning of the remote controllable device. As an example, a value of the channel attribute of a television determines which television channel is shown on a screen of the television. As another example, a value of a switch off timer attribute of a television determines after how long the television is switched off.

The first remote controllable device identification unit is associated 116 with the first remote controllable device and holds a first device identifier 117. The second remote controllable device identification unit is associated 126 with the second remote controllable device and holds a second device identifier 127. An association between an identification unit and a remote controllable device means that the identification unit identifies the respective remote controllable device.

The identification unit 115, 125 may be integrated and/or comprised in a respective remote controllable device the identification unit is associated with. An identification unit may be a separate entity next to a remote controllable device. An identification unit may be associated with a remote controllable device by integration of the identification unit in the remote controllable device. This integration may take place during manufacturing and/or installation of a domestic appliance system and/or remote controllable device. An identification unit may be associated with a remote controllable device during manufacturing, installation and/or power-up of a domestic appliance system.

A remote controllable device may comprise a beacon for emitting, such as omnidirectional emitting, a beacon identifier, hence creating an association between the remote controllable device and the beacon. Comprise in this sense may be integrated in, placed adjacent of or placed in proximity of each other. The beacon may emit the beacon identifier as IR code. The remote control may comprise an input device 151 and/or a pointing detection unit 140. The pointing detection unit may be a directional sensitive sensor, such as a camera, which camera may be sensitive to IR. The beacon may be a remote controllable device identification unit, the beacon identifier may be a respective device identifier. An example of a remote control and a beacon is respectively au Wand of Philips and a beacon 10 from Philips, as introduced in the white paper philips-uwand-for-smarter-homes.pdf on the Philips website (http://www.ip-.phlips.com/data/downloadables/1/9/7/0/philipa-uwand-for-smarter-homes.pdf).

The pointing detection unit 140 detects where the remote control 150 is pointing at. The remote control in FIG. 1 in a first position I is pointing 156 at the first remote controllable device, which is detected by the pointing detection unit. The remote control in FIG. 1 in a second position II is pointing 156' at the second remote controllable device, which is also detected by the pointing detection unit.

In an alternative embodiment, a pointing detection unit is comprised in a remote controllable device. A remote control may emit a directional visual identifier, such as a focussed IR beam. The pointing detection unit may be an IR detector receiving the focussed IR beam of the remote control.

The input device 151 of the remote control 150 may be a switch, a key, a slider, push button and/or two push buttons. The input device may be activated and deactivated. An activation may be to push a first button and a deactivation may be to push a second button. An activation may be to push and hold a button and deactivation may be to release the button. An activation may be to flip a switch from a first position to a second position, a deactivation may be to flip the switch from the second position back to the first position. An activation may be to slide a slider from a first position to a second position, a deactivation may be to slide the slider from the second position back to the first position.

If the remote control is pointing to the first remote controllable device and the input device is activated the remote control may command a read of the first attribute. If the remote control is pointing to the second remote controllable device and the input device is deactivated the remote control may command a write of the second attribute. A command of the remote control for a read or a write of an attribute may be transmitted wired and/or wireless to the remote controllable device 120, 130. Examples of wireless transmissions are WiFi, ZigBee, Bluetooth, WiMax and/or IR code.

The first device identifier and the second device identifier identify respectively the first remote controllable device and the second remote controllable device. Upon commanding the read the control device receives 161 the first device identifier of the first remote controllable device. Upon commanding the write the control device receives 162 the second device identifier of the second remote controllable device. The control device, having knowledge of for which first attribute a first value may be received from the first remote controllable device by the control device, selects the first label, as a part of determining the third value. A first combination of the first device identifier and the first label identifies the first attribute for retrieving the first value.

Furthermore, the control device has knowledge of which first value of the first attribute may be converted to which third value for replacing the second value of the second attribute. The first device identifier and the second device identifier identify respectively the first remote controllable device and the second remote controllable device. After the control device 130 receives 160 the first value, the control device selects, as a part of determining the third value, a conversion from the first value into a third value by combining the knowledge of the control device and the received first and second device identifiers.

Between receiving the first and second device identifiers and transmitting the third value, the control device determines the second label. The control device, having knowledge of which third value may be sent to the second remote controllable device by the control device for replacing the second value, selects the second label, as a part of determining the third value. A second combination of the second device identifier and the second label identifies the second value.

The control device transmits 163 the third value to the second remote controllable device for replacing to the second value. The transmission may be a single cast or a broadcast. The transmission may take place after conversion or may take place after the remote control commands the write of the second attribute if the conversion is done before the write. The third value may be sent to the remote control for temporarily storing the third value in the remote control upon commanding the write of the second attribute.

Figure 2:
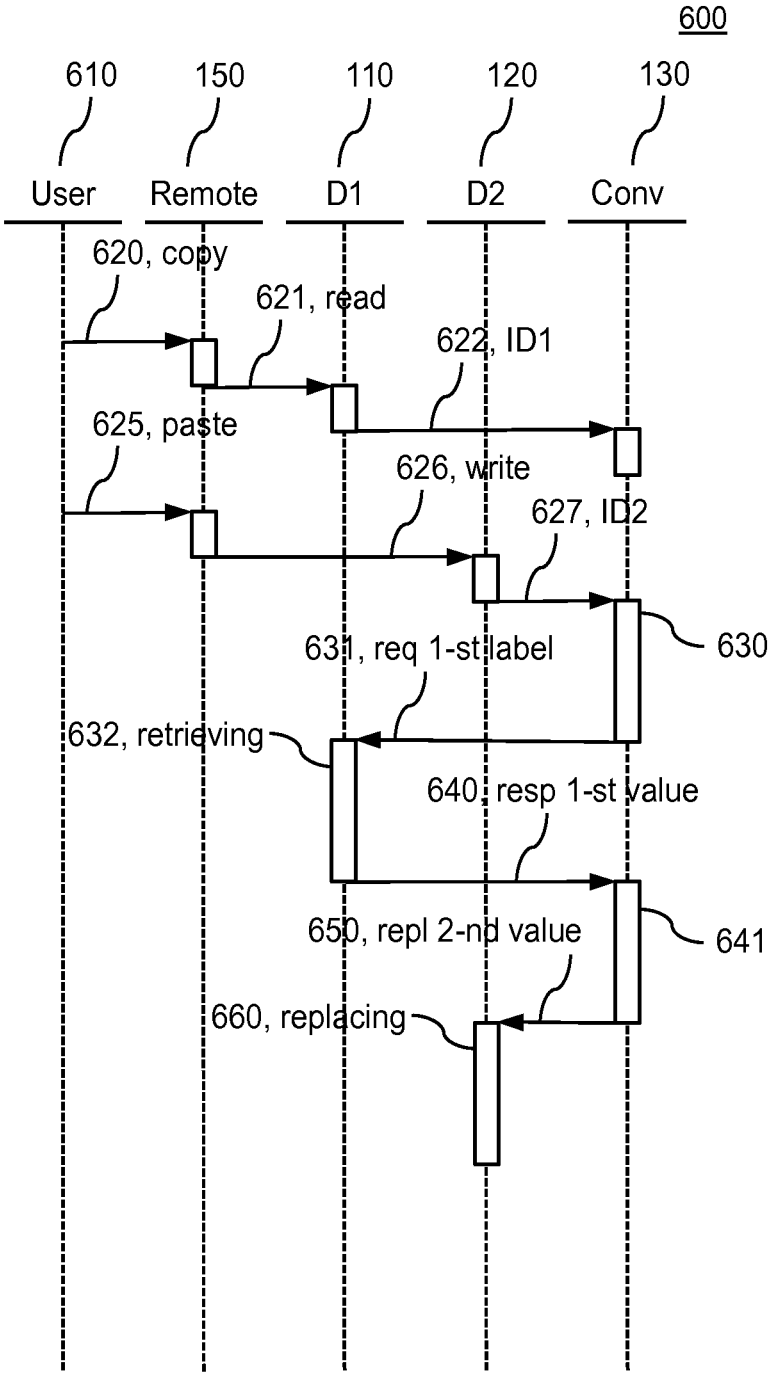
FIG. 2 shows a flow diagram of a first embodiment of a method for a domestic appliance system.

FIG. 2 shows a sequence diagram according to a first embodiment of the invention. The sequence diagram 600 comprises the following actors: a user 610, the remote control 150, the first remote controllable device 110, the second remote controllable device 120 and the control device 130.

The user starts the sequence diagram by giving the remote control a copy command 620 while pointing the remote control to the first remote controllable device. The remote control subsequently transmits a read command 621 to the first remote controllable device. The first remote controllable device transmits a first identification message 622 comprising its first device identifier to the control device.

The user subsequently gives the remote control a paste command 625 while pointing the remote control to the second remote controllable device. The remote control subsequently transmits a write command 626 to the second remote controllable device. The second remote controllable device transmits a second identification message 627 comprising its second device identifier to the control device.

The control device upon receiving the first and second device identifiers, as a part of determining the third value, selects 630 a first label of a first attribute of the first remote controllable device and a second label of a second attribute of the second remote controllable device. The control device transmits a request message 631 to the first remote controllable device, identifiable by the first device identifier, for retrieving 632 a first value of the first attribute.

Subsequently to receiving the request message, the first remote controllable device transmits in a response message 640 the first value to the control device. Upon receiving, the control device, as a part of determining the third value, converts 641 the first value into a third value. The third value together with the second label is then transmitted 650 in a replace message to the second remote controllable device, identifiable by the second device identifier.

The second remote controllable device upon receiving the replace message selects the second attribute based upon the received second label. A second value of the second attribute is replaced 660 with the third value. Hence the new value of the second attribute may change the functioning or influence of the second remote controllable device.

In an alternative embodiment of FIG. 2, the control device upon receiving the first and second device identifiers selects 630 the second label of a second attribute of the second remote controllable device at a later stage in time, but before the transmission of the replace message.

Figure 3:
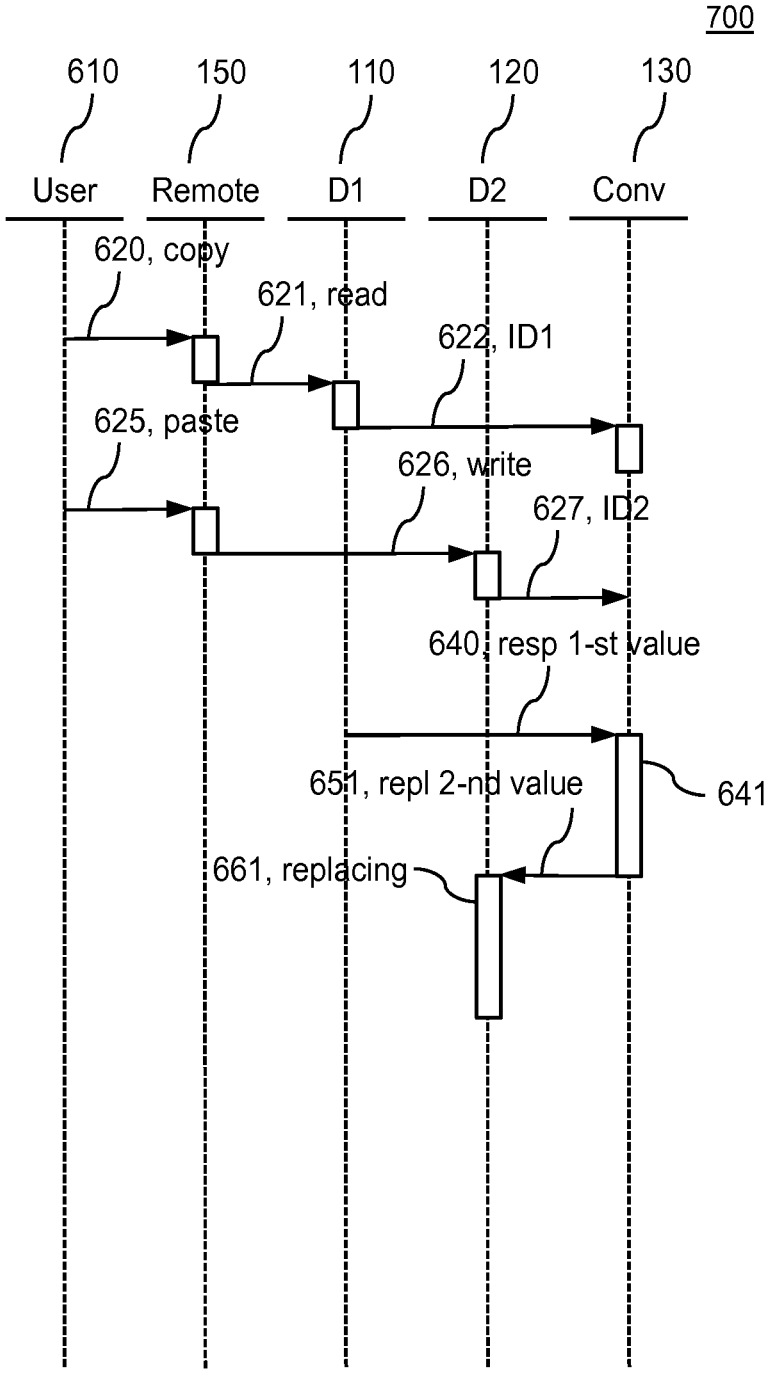
FIG. 3 shows a flow diagram of a second embodiment of a method for a domestic appliance system.

FIG. 3 shows a sequence diagram according to a second embodiment of the invention. The sequence diagram 700 comprises the following actors: the user 610, the remote control 150, the first remote controllable device 110, the second remote controllable device 120 and the control device 130.

The user starts the sequence diagram by giving the remote control a copy command 620 while pointing the remote control to the first remote controllable device. The remote control subsequently transmits a read command 621 to the first remote controllable device. The first remote controllable device transmits a first identification message 622 comprising its first device identifier to the control device.

The user subsequently gives the remote control a paste command 625 while pointing the remote control to the second remote controllable device. The remote control subsequently transmits a write command 626 to the second remote controllable device. The second remote controllable device transmits a second identification message 627 comprising its second device identifier to the control device.

Further upon receiving the read command, the first remote controllable device retrieves the first value for transmitting the first value in a response message 640 to the control device. The first controllable device may be able to select the value, because the first remote controllable device has only one readable attribute. The first controllable device may be select all values for transmission to the control device.

Upon receiving, the control device, as a part of determining the third value, converts 641 the first value into a third value. The third value is then transmitted in a replace message 651 to the second remote controllable device, identifiable by the second device identifier.

The second remote controllable device upon receiving the replace message selects the second attribute. A second value of the second attribute is replaced 661 with the third value. The second controllable device may be able to select the second value, because the remote controllable device has only one writable attribute. The second controllable device may be select all values for replacing by the value or values received from the control device. Hence the new value of the second attribute may change the functioning or influence of the second remote controllable device.

Figure 4:
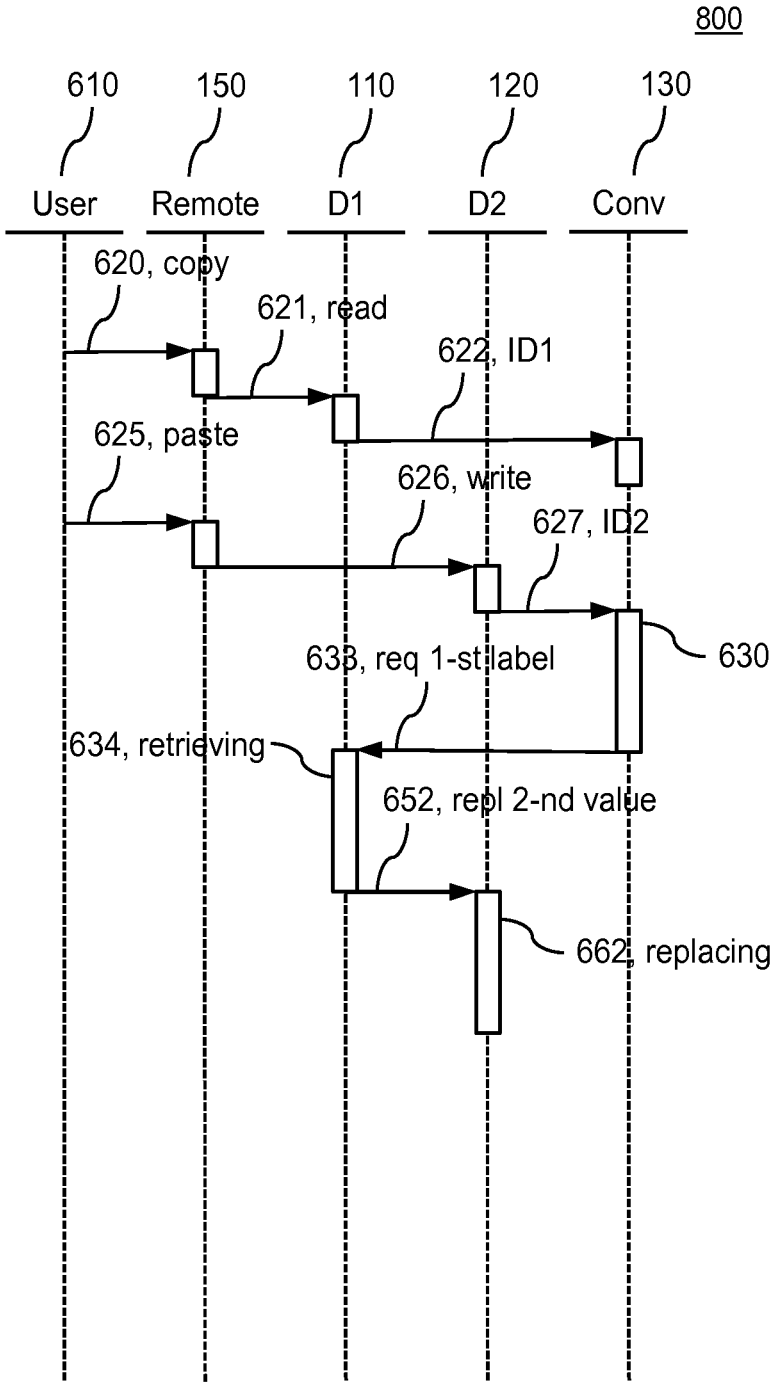
FIG. 4 shows a flow diagram of a third embodiment of a method for a domestic appliance system.

FIG. 4 shows a sequence diagram according to a third embodiment of the invention. The sequence diagram 800 comprises the following actors: the user 610, the remote control 150, the first remote controllable device 110, the second remote controllable device 120 and the control device 130.

The user starts the sequence diagram by giving the remote control a copy command 620 while pointing the remote control to the first remote controllable device. The remote control subsequently transmits a read command 621 to the first remote controllable device. The first remote controllable device transmits a first identification message 622 comprising its first device identifier to the control device.

The user subsequently gives the remote control a paste command 625 while pointing the remote control to the second remote controllable device. The remote control subsequently transmits a write command 626 to the second remote controllable device. The second remote controllable device transmits a second identification message 627 comprising its second device identifier to the control device.

The control device upon receiving the first and second device identifiers, as a part of determining the third value, selects 630 a first label of a first attribute of the first remote controllable device and a second label of a second attribute of the second remote controllable device. The control device transmits a request message 633 to the first remote controllable device, identifiable by the first device identifier, for retrieving 634 a first value of the first attribute. The request message 633 further comprises the second label of the second attribute and the second device identifier.

The first remote controllable device may select, as part of determining the third value, a relation to convert the first value into the third value. Alternatively the first remote controllable device may receive a relation from the control device for converting the first value into the third value. The first remote controllable device may convert the first value into the third value based on the relation. Hence part of the determining the third value, such as the conversion, may be executed in part or in whole on the remote controllable device, such as the first remote controllable device.

Subsequently to receiving the request message, the first remote controllable device transmits in a replace message 652 the third value, based on the first value, and the second label to the second remote controllable device, identifiable by the second device identifier. Upon receiving, the second remote controllable device replaces 662 the second value with a value based on the third value of the replace message. Hence the new value of the second attribute may change the functioning or influence of the second remote controllable device.

In an alternative embodiment, the first remote controllable device converts the first value to a third value. In an alternative embodiment, the second remote controllable device converts the third value in another value for replacing the second value. Or combinations of these two previous alternative embodiments.

Figure 5:
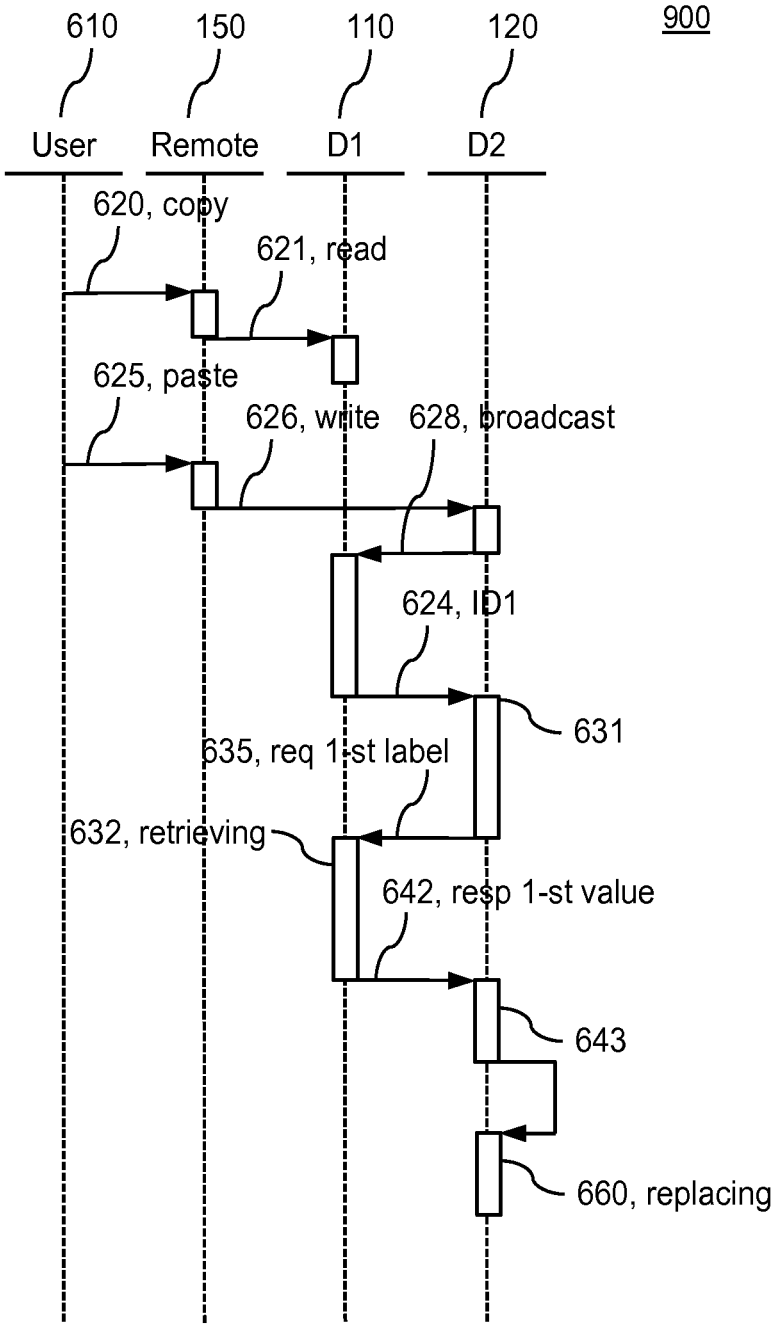
FIG. 5 shows a flow diagram of a fourth embodiment of a method for a domestic appliance system.

FIG. 5 shows a sequence diagram according to a fourth embodiment of the invention. The sequence diagram 900 comprises the following actors: the user 610, the remote control 150, the first remote controllable device 110 and the second remote controllable device 120. The second remote controllable device comprises the control device 130.

The user starts the sequence diagram by giving the remote control a copy command 620 while pointing the remote control to the first remote controllable device. The remote control subsequently transmits a read command 621 to the first remote controllable device.

The user subsequently gives the remote control a paste command 625 while pointing the remote control to the second remote controllable device. The remote control subsequently transmits a write command 626 to the second remote controllable device. The second remote controllable device transmits a second identification message 628 as broadcast comprising its second device identifier, which broadcast is received by the first remote controllable device. Upon receiving the broadcast, the first remote controllable device transmits a first identification message 624 comprising its first device identifier to the second remote controllable device.

The second remote controllable device upon receiving the first device identifier, as a part of determining the third value, selects 631 a first label of a first attribute of the first remote controllable device and a second label of a second attribute of the second remote controllable device. The second remote controllable device transmits a request message 635 to the first remote controllable device, identifiable by the first device identifier, for retrieving 632 a first value of the first attribute.

Subsequently to receiving the request message, the first remote controllable device transmits in a response message 642 the first value to the second remote controllable device. Upon receiving, the second remote controllable device, as a part of determining the third value, converts 643 the first value into a third value.

The second remote controllable device upon determining the third value selects the second attribute based upon the determined second label. A second value of the second attribute is replaced 660 with the third value. Hence the new value of the second attribute may change the functioning or influence of the second remote controllable device.

In an alternative embodiment of FIG. 5, the second remote controllable device upon receiving the first device identifier selects 630 the second label of a second attribute of the second remote controllable device at a later stage in time, but before the replacing 660.

Figure 6:
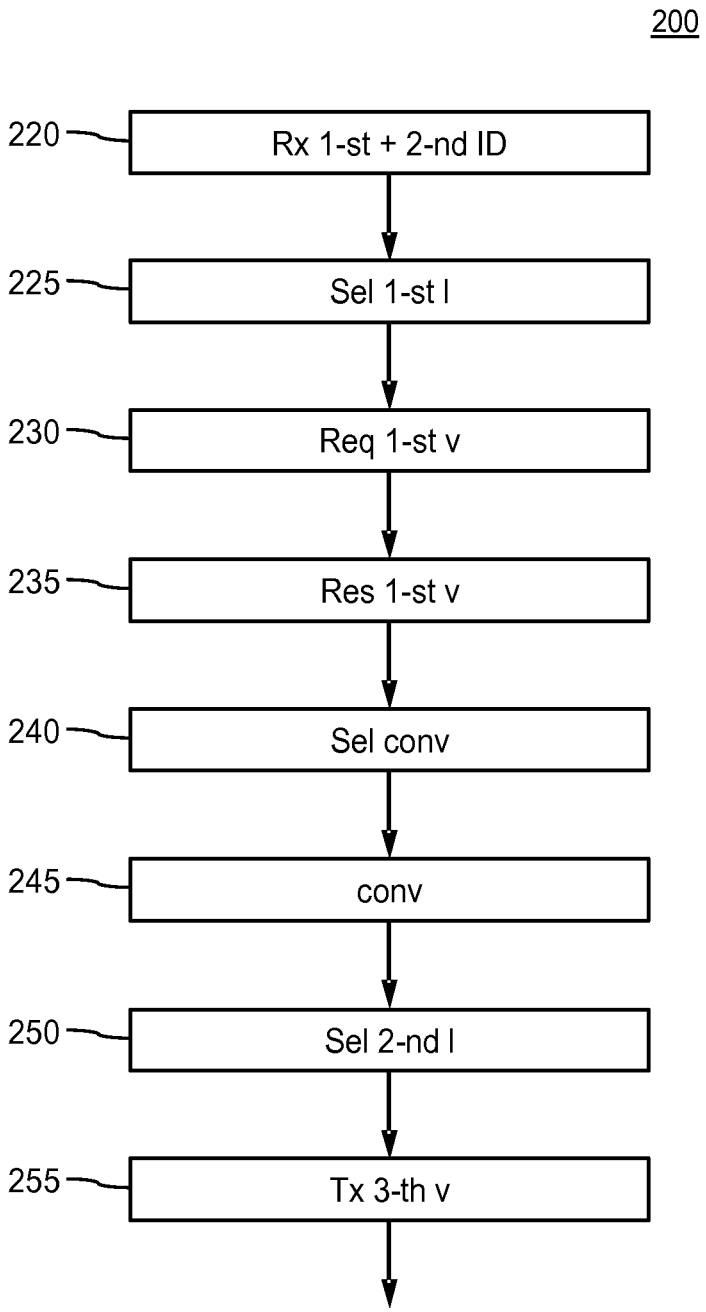
FIG. 6 shows schematically an embodiment of a control device.

FIG. 6 shows a flow diagram of an embodiment of a method 200 for a control device. The domestic appliance system comprises a first remote controllable device, a second remote controllable device, a remote control and a control device. The first remote controllable device is associated with a first device identifier. The second remote controllable device is associated with a second device identifier. The first remote controllable device has at least one attribute in use having a first label and a first value. The second remote controllable device has at least one attribute in use having a second label and a second value.

The method starts with receiving 220 the first and second device identifiers (Rx 1-st+2-nd ID). The first and second device identifiers are received upon reading and writing commands from the remote control.

The next step in the method is that the received first and second device identifiers are used for selecting 225, as part of determining the third value, the first label based on the first and second device identifiers and knowledge of which first value may be received from the first remote controllable device by the control device (Sel 1-st 1).

The next step in the method is that the control device transmits 230 a request message to the first remote controllable device for the first value of the first attribute identified by the first label (Req 1-st v). The next step in the method is that the control device receives 235 a response message from the first remote controllable device with the first value of the first attribute (Res 1-st v).

The next step in the method is that the control device selects 240, as part of determining the third value, a conversion for converting the first value in a third value (Sel conv). The selection is based on the first and second device identifiers. It will be obvious to the reader that the step of selecting the conversion may be done as early as after the step of receiving the first and second device identifiers and may be done as late as before the step of transmitting the third value.

The next step in the method is that the control device performs 245 the conversion for converting the first value into the third value (conv). The next step in the method is that the control device selects 250, as part of determining the third value, the second label based on the first and second device identifiers and knowledge of which second value may be replaced from the second remote controllable device by the control device (Sel 2-nd 1). It will be obvious to the reader that the step of selecting the second label may be done earlier in the method up until the step of receiving the first and second device identifiers.

The next step in the method is that the control device transmits 255 the third value to the second remote controllable device for replacing the second value of the second attribute identified by the second label (Tx 3-th v).

Figure 7:
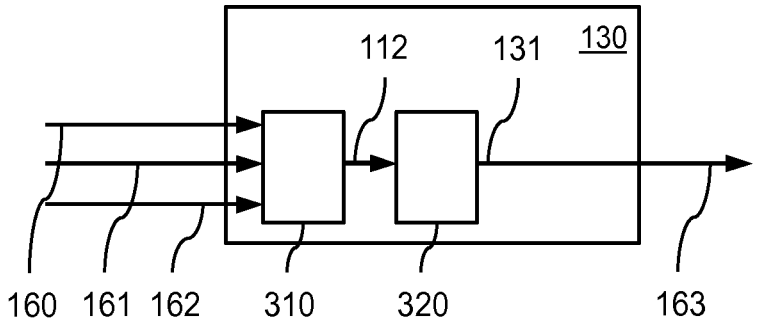
FIG. 7 shows an embodiment of a table of a conversion unit.

FIG. 7 shows schematically an embodiment of a control device 130. The control device comprises a reception unit 310 and a conversion unit 320.

The reception unit is configured for receiving 160 a first value of a first attribute of a first remote controllable device, receiving 161 a first device identifier and receiving 162 a second device identifier. The reception unit forwards the received information to the conversion unit.

The conversion unit is configured for converting the first value in a third value for replacing the second value based on the received information from the reception unit.

FIG. 8A shows an embodiment of a first table 500 of a conversion unit for a domestic appliance system. The table comprises, in this embodiment, rows and columns. The first row comprises device identifiers associated with the remote controllable device. These device identifiers identify each remote controllable device in the domestic appliance system. The second row comprises a brief description of the remote controllable device having a device identifier associated with the remote controllable device. As an example two lamps of different type, one picture frame and one smart television are present in the domestic appliance system.

The first column comprises attribute labels. The attribute labels may be picture A, picture B, intensity, light colour A, light colour B, lamp user interface A and lamp user interface B. Hence the attributes are standardized for this remote controllable system. This may be seen as that the control device uses intermediate attributes having intermediate labels and values, wherein a part of the conversion takes place in the remote controllable device by requesting or replacing the appropriate values in the remote controllable devices. For example, the control device may use the first device identifier and first label to send the request message to the first remote controllable device to retrieve the first value. The request message may furthermore comprise a first relation and/or the intermediate label. The first remote controllable device then converts the retrieved first value to the intermediate value, based on the first relation or a relation identified by the intermediate label. The first relation identified by the intermediate label may be already present in the first remote controllable device. The intermediate value is sent to the control device. The control device forwards the intermediate value to the second remote controllable device together with the second label and/or the intermediate label. The second remote controllable device then converts the intermediate value to the third value, based on a second relation or a relation identified by the intermediate label. The second relation identified by the intermediate label may be already present in the second remote controllable device. The third value is used for replacing the second value of the second attribute.

The picture A attribute is provided with a picture A value in a Bitmap (BMP) format. The picture B attribute is provided with a picture B value in a JPEG format. The light colour A attribute is provided with a light colour A value in a RGB format. The light colour B attribute is provided with a light colour B value in a Hue saturation format. The lamp UI A attribute is provided with a value in a basic UI format. The lamp UI B attribute is provided with a value in an extended UI format.

The table cells for each individual remote controllable device per attribute provide information if a value of the attribute may be read (R) and/or written (W). Reading an attribute allows the attribute value to be retrieved. Writing an attribute allows the attribute value to be replaced. An empty table cell indicates that the control device has no capabilities of reading from or writing to the attribute.

As a first example if the picture frame is taken as a first remote controllable device and the smart television as a second remote controllable device. The control device may select a retrieval, as a part of determining the third value, which retrieves either the picture A or B value of the picture frame for replacing respectively the picture A or B value of the smart television, hence transferring picture information from the picture frame to the smart television. The selection between the two possible retrievals may be made arbitrary or may be made on, for example, quality requirements and/or size of information to be transferred.

As a second example the reverse direction of information transport of the first example. Shown in the table is that the picture frame does not support writing of the picture B value. Hence the control device selects a retrieval, as a part of determining the third value, that retrieves the picture A value of the smart television for replacing the picture A value of the picture frame.

As a third example if the smart television is taken as a first remote controllable device and the lamp type 1 is taken as a second remote controllable device. The control device may select a retrieval, as a part of determining the third value, that retrieves either the light colour A value or lamp UI A value of the smart television for replacing respectively the light colour A value or lamp UI A value of the smart television, hence transferring picture information from the picture frame to the lamp type 1. The selection between the two possible retrievals may be made arbitrary or may be made on, for example, quality requirements and/or size of information to be transferred. The use of a light colour A value is not possible, because the lamp type 1 does not allow writing to the light colour value.

FIG. 8B shows a first embodiment of a second table 510 for selecting, as part of determining the third value, the conversion. An example may be a domestic appliance system comprising a control device, comprising the second table 510, wherein the domestic appliance system further comprises a television and a picture frame as remote controllable devices. The television is identified with device identifier 1. The picture frame is identified with device identifier 2. The first column specifies the remote controllable devices as source or first remote controllable device. The first row specifies the remote controllable devices as destination or second remote controllable device. The television may provide a value of a screen attribute specifying what is shown on the television screen. The value of the screen attribute may be available in MPEG4 value. The picture frame may provide a value of a picture attribute specifying what is shown in the picture frame. The value of the picture attribute may be accepting JPEG format. An 'x' in a cell of the second table specifies a relation or a pointer to a relation specifying the conversion that the control device has available.

When a user initiates a drag and drop between a first remote controllable device and a second remote controllable device with the use of the remote control, the control device receives a first and second device identifier. After receiving the device identifiers the control device may determine if a conversion is available between the two devices.

For example if a user drags from the television by pointing to the television with the remote control and drops on the picture frame by pointing to the picture frame with the remote control, the control device, after receiving the device identifiers, may determine that a conversion is available. The available conversion in this example should be from a JPEG format to a MPEG4 format.

As another example if a user drags from the picture frame by pointing to the picture frame with the remote control and drops on the television by pointing to the television with the remote control, the control device, after receiving the device identifiers, may determine that no conversion is available. Hence the control device may not convert any value.

In an embodiment of the control device, the conversion unit comprises a relation. As an example, a conversion of not identical attributes are a colour temperature attribute of a remote controllable lamp and the screen colour attribute of a television set. A value of the colour temperature attribute may be defined as the temperature of an ideal black-body radiator. A value of the screen colour attribute may be defined as an RGB value in a CIE 1931 colour space. Hence to provide the user with an intuitive domestic appliance system for dragging from the remote controllable lamp to dropping on the television set with the use of a remote control, the control device may need a conversion from the colour temperature attribute value as first value into the RGB colour attribute value as second value.

Figure 9:
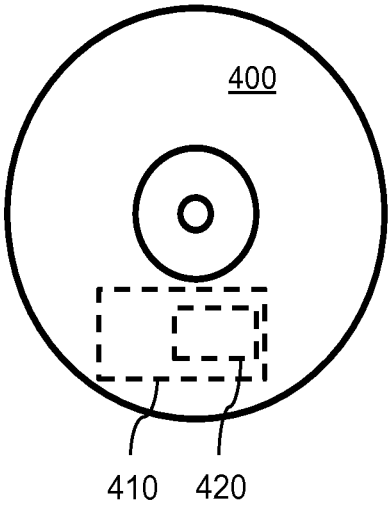
FIG. 9 shows schematically an embodiment of a computer program product.

FIG. 9 shows schematically an embodiment of a computer program product, a computer readable medium or a non-transitory computer readable storage medium 400 having a writable part 410 including a computer program 420, the computer program including instructions for causing a processor system to perform steps according to a method of an embodiment.

It is to be noted that the invention may be implemented in hardware and/or software, using programmable components. A method for implementing the invention has the steps corresponding to the functions defined for the system as described with reference to FIGS. 1-9. The functions introduced in the different embodiments of the invention may be stored in a memory and executed by a processor coupled to the memory.

In an embodiment, the control device 130 for controlling a domestic appliance system 100 may comprises: a first remote controllable device 110, a second remote controllable device 120 and a remote control 150. The remote control typically comprises a pointing detection unit 140 configured for identifying a remote controllable device 110, 120 at which the remote control is pointing 156, 156'. The remote control is configured for commanding a read in response to a user input commanding a copy while the user points the remote control at the first device and the remote control is configured for commanding a write in response to a user input commanding a paste while the user points the remote control at the second device. The control device comprises: a reception unit 310 configured for receiving a first value of the first device in response to the read; and a conversion unit 320 coupled to the reception unit configured for determining a third value based on the first value for replacing a value of the second device in response to the write for influencing the functioning of the second device. Hence the control device couples remote controllable devices of a domestic appliance system for providing the user with an intuitive drag and drop system for controlling these devices.

It will be appreciated that the above description for clarity has described embodiments of the invention with reference to different functional units and processors. However, it will be apparent that any suitable distribution of functionality between different functional units or processors may be used without deviating from the invention. For example, functionality illustrated to be performed by separate units, processors or controllers may be performed by the same processor or controllers. Hence, references to specific functional units are only to be seen as references to suitable means for providing the described functionality rather than indicative of a strict logical or physical structure or organization. The invention can be implemented in any suitable form including hardware, software, firmware or any combination of these.

It is noted, that in this document the word 'comprising' does not exclude the presence of other elements or steps than those listed and the word 'a' or 'an' preceding an element does not exclude the presence of a plurality of such elements, that any reference signs do not limit the scope of the claims, that the invention may be implemented by means of both hardware and software, and that several 'means' or 'units' may be represented by the same item of hardware or software, and a processor may fulfil the function of one or more units, possibly in cooperation with hardware elements. Further, the invention is not limited to the embodiments, and the invention lies in each and every novel feature or combination of features described above or recited in mutually different dependent claims.

ABBREVIATIONS

| | |
|---|---|
| BMP | Bitmap |
| IR | infrared |
| JPEG | Joint Photographic Experts Group |
| UI | user interface |

LIST OF REFERENCES

| | |
|---|---|
| 100 | domestic appliance system |
| 110 | first remote controllable device |
| 111 | first attribute |
| 112 | first value |
| 113 | first label |
| 115 | first remote controllable device identification unit |
| 116 | first association |
| 117 | first device identifier |
| 120 | second remote controllable device |
| 121 | second attribute |
| 122 | second value |
| 123 | second label |
| 125 | second remote controllable device identification unit |
| 126 | second association |
| 127 | second device identifier |
| 130 | control device |
| 131 | third value |
| 140 | pointing detection unit detecting |
| 141 | detection data |
| 150 | remote control |
| 151 | input device |
| 156 | remote control pointing to first remote controllable device |
| 156' | remote control pointing to second remote controllable device |
| 160 | receiving first value |
| 161 | receiving first device identifier |
| 162 | receiving second device identifier |
| 163 | transmitting third value |
| 164 | receiving first label |
| I | remote control at a first position |
| II | remote control at a second position |
| 200 | flow diagram of a method for a control device |
| 220 | receiving the first and second device identifiers |
| 225 | selecting the first label |
| 230 | transmitting a request message for the first value |
| 235 | receives a response message with the first value |
| 240 | selecting a conversion for converting the first value in a third value |
| 245 | converting the first value into the third value |
| 250 | selecting the second label |
| 255 | transmitting the third value for replacing the second value |
| 310 | reception unit |
| 320 | conversion unit |
| 400 | computer program product |
| 410 | writable part |
| 420 | computer program |
| 500 | first table |
| 510 | second table |
| 600 | first embodiment of a sequence diagram |
| 610 | user |
| 620 | copy message |
| 621 | read message |
| 622 | message comprising the first device identifier |
| 625 | paste message |
| 626 | write message |
| 627 | message comprising the second device identifier |
| 628 | broadcast message, broadcasting the second device identifier |
| 630 | selecting, as part of determining the third value, the first and second label |
| 631, 633, 635 | request message for requesting the first value |
| 632, 634 | retrieving the first value |
| 640, 642 | response message comprising the first value |
| 641, 643 | converting, as part of determining the third value, the first value into the third value |
| 650, 651, 652 | replace message for replacing the second value |
| 660, 661, 662 | replacing the second value with the third value |
| 700 | second embodiment of a sequence diagram |
| 800 | third embodiment of a sequence diagram |
| 900 | fourth embodiment of a sequence diagram |

The invention claimed is:

1. A control device for controlling a domestic appliance system comprising:

a reception unit, wherein the reception unit is arranged to receive a first device identifier in response to a read, wherein the reception unit is arranged to receive a second device identifier in response to a write;

a conversion unit coupled to the reception unit, wherein the conversion unit is arranged to determine a third value for replacing a second value based on the first device identifier, the second device identifier and a first value, wherein the domestic appliance system comprises:

a first remote controllable device, wherein the first remote controllable device has at least one first attribute in use, wherein the at least one first attribute comprises a first label and the first value, wherein the at least one first attribute is arranged to control the first remote controllable device, wherein the first remote controllable device is associable with the first device identifier;

a second remote controllable device, wherein the second remote controllable device has at least one second attribute in use, wherein the at least one second attribute comprises a second label and the second value, wherein the at least one second attribute is arranged to control the second remote controllable device, wherein the second remote controllable device is associable with the second device identifier;

a remote control comprising an input device, wherein the input device is arrange to receive user input;

a pointing detection unit, wherein the pointing detection unit is arranged to identify one of the first remote controllable device and the second remote controllable device at which the remote control is pointing, based on a device identifier associated with one of the first remote controllable device and the second remote controllable device;

wherein the remote control is arranged to command the read in response to a user input commanding a copy while the user points the remote control at the first remote controllable device, wherein the remote control is arranged to command the write in response to a user input commanding a paste while the user points the remote control at the second remote controllable device.

2. The control device according to claim 1, wherein determining the third value comprises selecting the first label, based on the first device identifier and the second device identifier, wherein the conversion unit is arranged to transmit the first label to the first remote controllable device so as to retrieve the first value.

3. The control device according to claim 1, wherein determining the third value comprises selecting, based on the first device identifier and the second device identifier, wherein the conversion unit is arranged to transmit the second label the second label to the second remote controllable device so as to replace the second value.

4. The control device according to claim 1, wherein determining the third value comprises selecting a conversion, based on the first device identifier and the second device identifier, wherein the conversion unit is arranged to convert the first value into the third value.

5. The control device according to claim 1,
wherein the conversion unit is arranged to determine at least one of the first label or the second label using at least one of a first table or a conversion,
wherein the conversion converts the first value into the third value, using a second table.

6. The control device according to claim 1,
wherein the conversion unit is arranged to determine an intermediate value based on the first device identifier and the first value,
wherein the conversion unit is arranged to determine the third value based on the second device identifier and the intermediate value.

7. The control device according to claim 1,
wherein the conversion unit is arranged to determine at least one of the first label and the second label using at least one of a first table and a conversion,
wherein the conversion converts the first value into the third value, using a second table.

8. A domestic appliance system comprising:
a first remote controllable device,
wherein the first remote controllable device has at least one first attribute in use,
wherein the at least one first attribute comprises a first label and a first value,
wherein the at least one first attribute is arranged to control the first remote controllable device,
wherein the first remote controllable device is associable with a first device identifier;
a second remote controllable device,
wherein the second remote controllable device has at least one second attribute in use,
wherein the at least one second attribute comprises a second label and a second value,
wherein the at least one second attribute is arranged to control the second remote controllable device,
wherein the second remote controllable device is associable with a second device identifier;
a remote control comprising an input device configured for receiving user input;
a pointing detection unit, wherein the pointing detection unit is arranged to identify one of the first remote controllable device and the second remote controllable device at which the remote control is pointing, based on a device identifier associated with one of the first remote controllable device and the second remote controllable device,
wherein the remote control is arranged to command a read in response to a user input commanding a copy while a user points the remote control at the first remote controllable device,
wherein the remote control is arranged to command a write in response to a user input commanding a paste while the user points the remote control at the second remote controllable device; and
a control device, the device comprising:
a reception unit,
wherein the reception unit is arranged to receive the first device identifier in response to the read,
wherein the reception unit is arranged to receive the second device identifier in response to the write;
a conversion unit coupled to the reception unit, wherein the conversion unit is arranged to determine a third value for replacing the second value based on the first device identifier, the second device identifier and the first value.

9. The domestic appliance system according to claim 7,
wherein the remote control comprises the pointing detection unit;
wherein the pointing detection unit is a directional sensitive sensor,
wherein the directional sensitive sensor is arranged to detect a beacon identifier emitted by a beacon associated with one of the first remote controllable device and the second remote controllable device,
wherein the directional sensitive sensor is arranged to determine at which of the first remote controllable device and the second remote controllable device the remote control is pointing,
wherein the beacon identifier is the device identifier.

10. The domestic appliance system according to claim 8,
wherein the reception unit of the control device is configured for receiving the first value from the first remote controllable device; and
wherein determining the third value comprises converting the first value into the third value, based on the first device identifier and the second device identifier.

11. The domestic appliance system according to claim 8,
wherein the first attribute is arranged to enable control of the first remote controllable device;
wherein the first remote controllable device is configured for receiving a read command; and
the first remote controllable device is arranged for transmitting the first value, upon receiving the first value.

12. The domestic appliance system according to claim 11, wherein the first remote controllable device is selected from the group consisting being one of a group of devices consisting of a television, a DVD player, a radio, a CD player, a lamp, an air conditioner, a microwave oven, an air heat oven, a stove, a refrigerator, a lamp, a thermostat, a computer, a tablet and a smartphone.

13. A method for controlling a device, wherein the device comprises:
a reception unit,
wherein the reception unit is arranged to receive a first device identifier in response to a read,
wherein the reception unit is arranged to receive a second device identifier in response to a write;
a conversion unit coupled to the reception unit, wherein the conversion unit is arranged to determine a third value for replacing a second value based on the first device identifier, the second device identifier and a first value,
wherein the domestic appliance system comprises:
a first remote controllable device,
wherein the first remote controllable device has at least one first attribute in use,
wherein the at least one first attribute comprises a first label and the first value,
wherein the at least one first attribute is arranged to control the first remote controllable device,
wherein the first remote controllable device is associable with the first device identifier;
a second remote controllable device,
wherein the second remote controllable device has at least one second attribute in use,
wherein the at least one second attribute comprises a second label and the second value,
wherein the at least one second attribute is arranged to control the second remote controllable device,
wherein the second remote controllable device is associable with the second device identifier;
a remote control comprising an input device, wherein the input device is arrange to receive user input;

a pointing detection unit, wherein the pointing detection unit is arranged to identify one of the first remote controllable device and the second remote controllable device at which the remote control is pointing, based on a device identifier associated with one of the first remote controllable device and the second remote controllable device;

wherein the remote control is arranged to command the read in response to a user input commanding a copy while the user points the remote control at the first remote controllable device, wherein the remote control is arranged to command the write in response to a user input commanding a paste while the user points the remote control at the second remote controllable device, the method comprising:

receiving the first device identifier in response to the read and the second device identifier in response to the write; and determining a third value for replacing the second value based on the first device identifier, the second device identifier and the first value.

14. A computer program stored on a non-transitory medium, wherein the computer program when executed on processor performs the method as claimed in claim 13.

* * * * *